United States Patent [19]

Katsuta et al.

[11] 4,317,691

[45] Mar. 2, 1982

[54] LIQUID OR GELLED NITROPARAFFIN AND METAL PERCHLORATE CONTAINING EXPLOSIVE COMPOSITION

[75] Inventors: Takeshi Katsuta, Sagamihara; Yoshiyuki Ikeda; Atsuo Inoue, both of Yamaguchi, all of Japan

[73] Assignees: Director, Technical Research and Development Institute, Japan Defence Agency; Nippon Kayaku Kabushiki Kaisha, both of Tokyo, Japan

[21] Appl. No.: 101,706

[22] Filed: Dec. 10, 1979

[30] Foreign Application Priority Data

Dec. 25, 1978 [JP] Japan ..... 53-158597

[51] Int. Cl.[3] ..... C06B 25/00; C06B 45/00

[52] U.S. Cl. ..... 149/2; 149/75; 149/78; 149/89

[58] Field of Search ..... 149/75, 78, 83, 89, 149/2

[56] References Cited

U.S. PATENT DOCUMENTS

| | | | |
|---|---|---|---|
| 3,035,948 | 5/1962 | Fox | 149/89 |
| 3,695,947 | 10/1972 | Edwards | 149/75 |
| 3,966,516 | 6/1976 | Sakai et al. | 149/75 |
| 4,097,316 | 6/1978 | Mullay | 149/89 |
| 4,141,766 | 2/1979 | Cameron et al. | 149/78 |

FOREIGN PATENT DOCUMENTS

| | | | |
|---|---|---|---|
| 1571216 | 2/1972 | Fed. Rep. of Germany | 149/75 |

*Primary Examiner*—Edward A. Miller

*Attorney, Agent, or Firm*—Russell & Nields

[57] ABSTRACT

This invention relates to a liquid explosive composition comprising 2 to 40 weight percent of formamide, 2 to 40 weight percent of alcohol, 3 to 70 weight percent of nitroparaffin and 10 to 80 weight percent of a metal salt of perchloric acid and to a gelled explosive composition comprising the above components, 2 to 20 weight percent of an organic thickening agent and/or 1 to 15 weight percent of an aerating agent. The present invention is also concerned with a method of producing the explosive compositions of the character mentioned above.

4 Claims, No Drawings

LIQUID OR GELLED NITROPARAFFIN AND METAL PERCHLORATE CONTAINING EXPLOSIVE COMPOSITION

This invention relates to liquid and gelled explosives which are capable of being manufactured in a safe and simple manner and to the method of producing same. More particularly, this invention is concerned with a liquid explosive composition comprising 2 to 40 weight percent of formamide, 2 to 40 weight percent of alcohol, 3 to 70 weight percent of nitroparaffin and 10 to 80 weight percent of a metal salt of perchloric acid, and with a gelled explosive composition comprising the above components, 2 to 20 weight percent of an organic thickening agent and/or 1 to 15 weight percent of an aerating agent; and is concerned with a method of producing the explosive compositions of the character mentioned above.

The present inventors have taken notice of the high solubility of a metal salt of perchloric acid in alcohols, and have continued a series of studies with a view to sensitizing the alcohol solutions of metallic perchlorates for the application thereof to an explosive.

As described in Japanese Patent Publication No. 16925 of 1976, it is well known that a high-powered liquid explosive can be obtained by adding a small amount of a concentrated hydrogen peroxide solution to the alcohol solution of a metal salt of perchloric acid.

However, in this liquid explosive the concentrated solution of hydrogen peroxide has such a strong oxidizing power that there is danger of skin injury in the event of contact with skin or clothing when at work. Further, the concentrated solution of hydrogen peroxide is chemically unstable so that the liquid explosive spontaneously decomposes due to the impurities, such as lead, leading to the elimination of the explosive power and danger of ignition. It has such disadvantages, so there are still problems from the standpoint of practical use.

For eliminating such drawbacks, the present inventors have conducted a study as to whether or not the slcohol solutions of metal salts of perchloric acid could be sensitized with a more stable substance, and have focused their attention on nitroparaffin which is stable is an additive but has an ability for detonation under specific conditions. However, if nitroparaffin is added to the alcohol solution of a metal salt of perchloric acid, the metal salt of perchloric acid is separated out due to the extremely high solubility of nitroparaffin in an alcohol solution, so that the solution no longer exhibits the state of a liquid explosive and its sensitivity becomes extremely poor, sometimes its explosive ability being also lost.

With a view to finding out how nitroparaffin is dissolved in the alcohol solution of a metal salt of perchloric acid, the present inventors have conducted various studies on a number of solubilizers and have invented that if formamide is added to this system as a solubilizer, nitroparaffin is completely dissolved in the solution, which displays satisfactorily high sensitivity and performance as an explosive. In other words, a proper amount of formamide and nitroparaffin are added successively or simultaneously to an adequate amount of the alocohol solution of a metal salt of perchloric acid and those mixtures are thoroughly stirred until they are completely dissolved so that this mixed solution is found to have the high sensitivity for initiating the detonation with Detonator No. 6 and the high performance that the detonation velocity is more than 6000 m/sec.

As a result of further intensive studies, the present inventors have found that the property and performance of said liquid explosive does not depend upon the order of addition in which a metal salt of perchloric acid, alcohol, formamide and nitroparaffin are added for the preparation of the liquid explosive. However, in the prefered method producing the present invention, non-explosive liquid components of alcohol, formamide and nitroparaffin are previously mixed and a metal salt of perchloric acid is added to said mixture. Moreover, in the present invention non-explosive liquid components of alcohol, formamide and nitroparaffin are previously mixed and just before use, the liquid explosive with high sensitivity and performance can be readily prepared at a work site by adding to said mixture a suitable amount of a metal salt of perchloric acid which is not sensitive to detonation all by itself. Further, in the liquid explosive of the present invention, the explosive composition in such a character that it does not freeze or separates out in a crystallized condition even at the extremely low temperature of −20 ° C., can be obtained by changing the ratio of the components properly.

Furthermore, since the liquid explosive of the present invention does not include the components which lead to the spontaneous decomposition or the injuries from chemicals, it is much safer in handling than the conventional liquid explosives. The liquid explosive of the present invention is also able to contain a small amount of water so that the performance of the explosive can be converted arbitrarily by the addition of a proper amount of water. On the contrary, when a large amount of water is added to the explosive, nitroparaffin is separated out of the solution due to the water-soluble property of three components except nitroparaffin and, consequently, said solution loses characteristically its explosive power. It means that the liquid explosive of the present invention can be easily disposed with water and is very convenient in the disposal of the residual and unexploded chemicals which have been a problem in the conventional liquid explosives. According to the present invention, the metal salts of perchloric acid include lithium perchlorate, sodium perchlorate, barium perchlorate, calcium perchlorate, strontium perchlorate, aluminum perchlorate, iron perchlorate, lead perchlorate, nickel perchlorate, silver perchlorate and their hydrates. They can be used alone or in combination. When a comparatively large amount of metallic perchlorate is used, the explosive becomes high-sensitive and high-powered. When its content is relatively small, the explosive becomes poor in both sensitivity and performance.

The appropriate proportion of metal salts of perchloric acid is in the range of 10 to 80%, based on the weight of the completed liquid explosive, but it is preferable to use a proportion of 20% to 70%.

Alcohols in liquid form can be employed, but lower alcohols, such as methyl alcohol, ethyl alcohol, propyl alcohol, isopropyl alcohol, butyl alcohol, isobutyl alcohol, ethylene glycol and glycerine, are preferred, and they can used alone or in combination. By use of a large amount of alcohol the sensitivity and performance of the completed explosive is reduced, but the use of too small an amount of alcohol brings out an incomplete dissolution of the metal salt of perchloric acid in the solution. The appropriate proportion of alcohols used is in the range of 2 to 40%, based on the weight of the completed liquid explosive, but it is preferable to use a proportion of 5% to 30%.

For nitroparaffin, a nitromethane, nitroethane, 1-nitropropane and 2-nitropropane having from 1 to 3 carbon atoms in the molecule thereof, can be employed alone or in combination. When too small an amount of notroparaffin is used, the sensitizing effect is reduced and, consequently, the completed liquid explosive becomes low-sensitive and low-powered. The appropriate proportion nitorparaffin used is in the range of 3 to 70%, but it is preferable to use a proportion of 10% to 50%.

In the present invention, the most characteristic formamide is the mutual solubilizer to metal salts of perchloric acid and nitorparaffin, and the proportion of formamide used may vary from 2 to 40%. When too small an amount of formamide is used, the solubilizing effect is reduced, and too large an amount of formamide brings about the decrease in the performance. Therefore, it is preferable to use a proportion of 5% to 30%.

The gelled explosive composition may be obtained readily by adding organic thickening agents, such as polyvinyl alcohol, methyl cellulose, guar gum, carboxymethyl and cellulose, and/or aerating agents, such as aerogel, silastic balloon and glass microballoon to the liquid explosive composition. They can be used alone or in combination. The appropriate proportion of said organic thickening agents added to the explosive composition is 2 to 20% by weight, the optimum amount thereof being 3 to 10% weight. The appropriate proportion of said aerating agents added to the explosive composition is 1 to 15% by weight, the appropriate proportion thereof being 2 to 10% by weight.

Further, it is, of course, possible to improve the oxygen balance and the performance of said explosive by adding thereto ammonium nitrate, calcium nitrate, potassium nitrate, sodium nitrate, metal salts of perthloric acid, etc., if necessary.

The present invention will now be described in detail by reference to the following examples.

EXAMPLE 1

The composition of each explosive is summarized in Table 1. For the explosive compositions from No. 1 to No. 5, their respective metal salts of perchloric acid had been previously dissolved in alcohol solutions to which the mixture of formamide and nitroparaffin was added for the preparation of the liquid explosive. For the explosive composition from No. 6 to No. 10, formamide, alcohol and nitroparaffin had been previously mixed to which a metal salt of perchloric acid was added for the preparation of the liquid explosive. The sensitivity to initiating detonation, detonation velocity and freezing temperature of the respective liquid explosive compositions are shown in Table 2.

The sensitivity to initiation of said explosive compositions was examined through the initiation test by use of Detonator No. 6 at the temperatures of 0° C. and 20° C. For the detonation velocity, the values measured by the Dortriche method according to Japanese Industrial Standard are shown in Table 2.

From this example it can be seen that Composition No. 2 containing a large amount of alcohol, Composition No. 4 containing a large amount of formamide and Composition No. 8 containing a small amount of the metal salt of perchloric acid are somewhat low-sensitive to initiation and rather low in detonation velocity.

TABLE 1

| | Composition (Wt %) | | | | | | | | | | |
|---|---|---|---|---|---|---|---|---|---|---|---|
| No. | Formamide | Methanol | Butyl alcohol | Ethylene glycol | Nitro-methane | Nitro-ethane | 2-nitro-propane | Lithim perchlorate | Barium perchlorate | Strontium perchlorate | Iron perchlorate |
| 1 | 8 | 20 | | | 20 | | | | 52 | | |
| 2 | 5 | 25 | | 5 | | 10 | | 25 | 25 | | |
| 3 | 10 | 15 | | | | | 30 | 30 | | | 15 |
| 4 | 30 | 9 | | 9 | 10 | 10 | | | | 32 | |
| 5 | 10 | 18 | | | 40 | | | | 38 | | |
| 6 | 12 | | 12 | | 20 | 10 | | 20 | 20 | 8 | |
| 7 | 14 | 5 | | | 11 | | | | 70 | | |
| 8 | 20 | | 5 | 5 | | | 50 | | 10 | | 10 |
| 9 | 8 | | | 12 | 40 | | | 40 | | | |
| 10 | 10 | 10 | | | 40 | | | | 40 | | |

TABLE 2

| No. | Detonator No. 6 20° C. | Detonator No. 6 0° C. | Detonation velocity (20° C.) | Freezing temperature |
|---|---|---|---|---|
| 1 | detonated | detonated | 6230m/sec | −28° C. |
| 2 | detonated | not detonated | 6050 | −35 |
| 3 | detonated | detonated | 6350 | −19 |
| 4 | detonated | not detonated | 6120 | −30 |
| 5 | detonated | detonated | 6650 | −25 |
| 6 | detonated | detonated | 6480 | −15 |
| 7 | detonated | detonated | 6670 | −2 |
| 8 | detonated | not detonated | 6140 | −35 |
| 9 | detonated | detonated | 6350 | −18 |
| 10 | detonated | detonated | 6510 | −22 |

EXAMPLE 2

After 2%, 5% and 30% of water were added to Compositions Nos. 1, 7 and 10 in Example 1 respectively, their sensitivty to initiation and detonation velocity were examined. Their composition and test results are shown in Table 3. It can been seen that a small amount of water reduces the sensitivity and detonation velocity, and a large amount of water eliminates the explosive power.

TABLE 3

| | Composition | | | | Results | | |
|---|---|---|---|---|---|---|---|
| | | | | | Detonator No. 6 | | Detonation velocity |
| No. | No. 1 | No. 7 | No. 10 | Water | 20° C. | 0° C. | 20° C. |
| 11 | 98% | | | 2% | detonated | detonated | 6040 m/sec |
| 12 | | 95% | | 5% | detonated | not detonated | 5130 m/sec |
| 13 | | | 70% | 30% | not detonated | not detonated | — |

EXAMPLE 3

An organic thickening agent, an aerating agent and an oxidizing agent were added to Compositions Nos. 5 and 10 in Example 1 and their sensitivity to initiation and detonation velocity were measured.

The liquid explosive of the present invention is seen to be high-sensitive and high-powered even though it is converted to a gelled explosive. Their composition and test results are shown in Tables 4 and 5.

TABLE 4

| | Composition | | | | | | | | |
|---|---|---|---|---|---|---|---|---|---|
| No. | No. 5 | No. 10 | Polyvinyl alcohol | Guar gum | Carboxy-methyl cellulose | Aerogel | Glass micro-balloon | Ammonium nitrate | Sodium nitrate |
| 14 | 90 | | 5 | | | | 5 | | |
| 15 | 95 | | | 5 | | | | | |
| 16 | | 90 | | | 3 | 7 | | | |
| 17 | | 95 | | | | 5 | | | |
| 18 | 88 | | 7 | | | | | 5 | |
| 19 | | 80 | 6 | | | | 4 | | 10 |

TABLE 5

| No. | Detonator No. 6 | | Detonation velocity |
|---|---|---|---|
| | 20° C. | 0° C. | 20° C. |
| 14 | detonated | detonated | 5750 m/sec |
| 15 | detonated | detonated | 6650 |
| 16 | detonated | detonated | 5570 |
| 17 | detonated | detonated | 6020 |
| 18 | detonated | detonated | 6250 |
| 19 | detonated | detonated | 5050 |

What we claim is:

1. A liquid explosive composition in solution state consisting essentially of 2 to 40 weight percent of formamide, 2 to 40 weight percent of alocohol, 3 to 70 weight percent of nitroparaffin and 10 to 80 weight percent of a metal salt of perchloric acid.

2. A liquid explosive composition in solution state according to claim 1, wherein 5 to 30 weight percent of formamide, 5 to 30 weight percent of alcohol, 10 to 50 weight percent of nitroparaffin and 20 to 70 weight percent of a metal salt of percloric acid are incorporated.

3. A liquid explosive composition in solution state according to claim 1, wherein methyl alcohol is employed as alcohol, nitromethane is employed as nitroparaffin and barium perchlorate is employed as a metal salt of perchloric acid.

4. A gelled explosive composition consisting essentially of (a) more than 80 weight percent of a liquid explosive component in solution state comprising 2 to 40 weight percent of formamide, 2 to 40 weight percent of alcohol, 3 to 70 weight percent of notroparaffin and 10 to 80 weight percent of a metal salt of perchloric acid; and (b) not more than 20 weight percent of an additive comprising 2 to 20 weight percent of an organic thickening agent and/or 1 to 15 weight percent of an aerating agent.

* * * * *